US010264901B2

(12) United States Patent
Andreas

(10) Patent No.: US 10,264,901 B2
(45) Date of Patent: Apr. 23, 2019

(54) DAMAGE RESISTANT GLASSWARE APPARATUS

(71) Applicant: Stefan Andreas, New Market, TN (US)

(72) Inventor: Stefan Andreas, New Market, TN (US)

( * ) Notice: Subject to any disclaimer, the term of this patent is extended or adjusted under 35 U.S.C. 154(b) by 490 days.

(21) Appl. No.: 14/885,711

(22) Filed: Oct. 16, 2015

(65) Prior Publication Data

US 2017/0105558 A1 Apr. 20, 2017

(51) Int. Cl.
*A47G 19/22* (2006.01)

(52) U.S. Cl.
CPC ..... *A47G 19/2227* (2013.01); *A47G 19/2205* (2013.01); *A47G 19/2261* (2013.01); *A47G 2019/2238* (2013.01)

(58) Field of Classification Search
CPC ..... A47G 19/2205; A47G 19/2227; A47G 19/2261; A47G 2019/2238; B65D 25/24
USPC ..... 206/217; 220/602, 626, 628, 630, 632, 220/636, 640, 643, 644, 645, 655; 29/428; 215/372, 376, 377; 248/346.11
See application file for complete search history.

(56) References Cited

U.S. PATENT DOCUMENTS 4,767,015 A * 8/1988 Ho ..... A47G 19/2261 215/372
5,158,193 A * 10/1992 Chen ..... A47G 19/2261 215/376
5,536,196 A * 7/1996 Sternberg ..... A47G 19/2227 206/217
6,152,018 A * 11/2000 Yeh ..... A47J 31/20 220/632
6,398,019 B1 * 6/2002 Cheng ..... A47G 19/2227 206/217
6,439,418 B1 * 8/2002 Immerman ..... B65D 25/24 220/626
6,921,179 B2 * 7/2005 Diak Ghanem ... A47G 19/2227 206/217
2002/0130133 A1 * 9/2002 Immerman ..... A47G 19/2255 220/630
2005/0205585 A1 * 9/2005 Chiu Huang ..... A47G 19/00 220/643
2010/0264045 A1 * 10/2010 Chen ..... A47G 19/2227 206/217
2013/0119075 A1 5/2013 Justiss

* cited by examiner

*Primary Examiner* — Luan K Bui

(74) *Attorney, Agent, or Firm* — Law Office of Jerry Joseph, PLC; Jerry K. Joseph

(57) ABSTRACT

A damage resistant glassware apparatus which includes a fluid container having a rim at a top end and a base at a bottom end, the fluid container constructed of a glass material, the rim to define an opening to a storage cavity within the fluid container, a first protective insert coupled to and integrally formed with the rim, and a second protective insert coupled to and integrally formed with the bottom end, wherein the first and second protective inserts are constructed of a non-glass material.

10 Claims, 6 Drawing Sheets

DAMAGE RESISTANT GLASSWARE APPARATUS

FIELD OF INVENTION

The present general inventive concept relates generally to glassware, and more particularly to damage resistant glassware apparatus having at least one integrated non-glass protective insert to protect the glassware.

BACKGROUND

Many people use glassware containers for various purposes, including consuming beverages at home, at restaurants, or at bars. Glass is a material that is widely used to construct drinking containers since glass does not react with liquids and acts as an effective insulator. However, due to a brittle nature of glass, edges and bottoms of glassware containers are susceptible to damage such as chipping and cracking when dropped or stacked. As a result, restaurants and bars spend a considerable amount of time and money replacing damaged glassware when dropped or stacked for storage.

Some previous solutions include using a plastic shell to line an interior portion of the container to protect the glassware. However, these solutions obstruct a view to the liquid (e.g. beer) stored within the container, thereby preventing the user from being visually stimulated by the liquid or being able to visualize an amount of liquid remaining.

Thus, a damage resistant glassware apparatus which protects the edges and bottoms of glassware containers while providing a user complete visibility to the contents stored within the container is desired.

BRIEF SUMMARY

Example embodiments of the present general inventive concept may be achieved by providing a damage resistant glassware apparatus which includes a fluid container having a rim at a top end and a base at a bottom end, the fluid container constructed of a glass material, the rim to define an opening to a storage cavity within the fluid container to store a fluid; and at least one of a first protective insert coupled to and integrally formed with the base and a second protective insert coupled to and integrally formed with the rim, wherein the first and second protective inserts are constructed of a non-glass material to protect the fluid container.

Example embodiments of the present general inventive concept may also be achieved by providing a method of manufacturing a damage resistant glassware apparatus which includes obtaining a fluid container having a rim at a top end and a base at a bottom end, the fluid container constructed of a glass material, the rim to define an opening to a storage cavity within the fluid container, forming a first protective insert constructed from a non-glass material and shaped identical to the rim of the fluid container, forming a second protective insert constructed from the non-glass material and shaped to have a diameter corresponding to the base of the fluid container, and affixing the first protective insert to the rim of the fluid container and the second protective insert to the base of the fluid container, wherein the first protective insert is configured to allow access to a fluid stored within the storage cavity and the first and second protective insert are affixed to the fluid container to provide visibility to the fluid stored within the storage cavity from all directions.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein. Numerous variations, modification, and additional embodiments are possible, and, accordingly, all such variations, modifications, and embodiments are to be regarded as being within the spirit and scope of the present general inventive concept.

Figure 1:
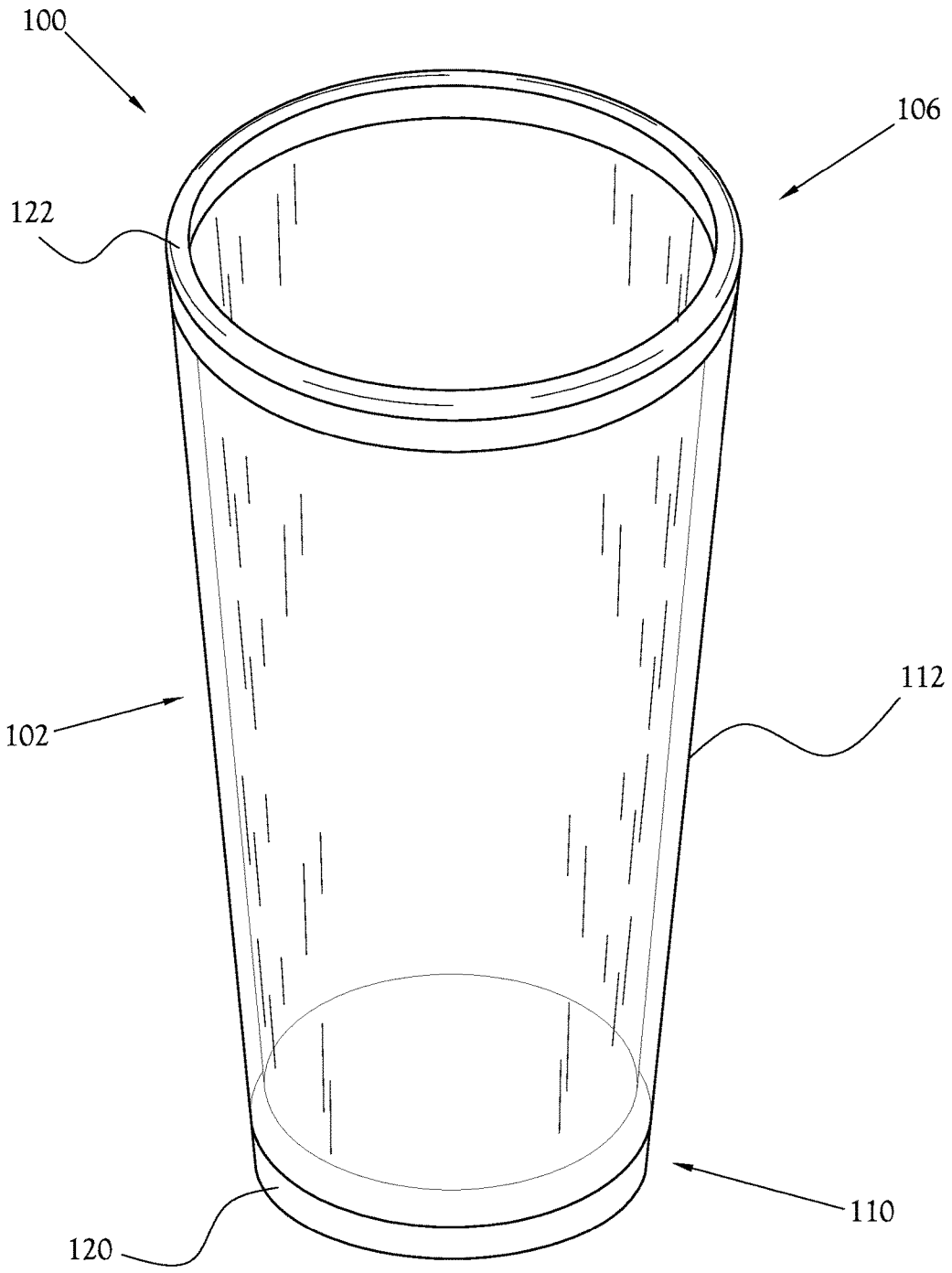
FIG. 1 is a front prospective view of a damage resistant glassware apparatus integrated with a first protective insert and a second protective insert according to an exemplary embodiment of the present general inventive concept.
Figure 2:
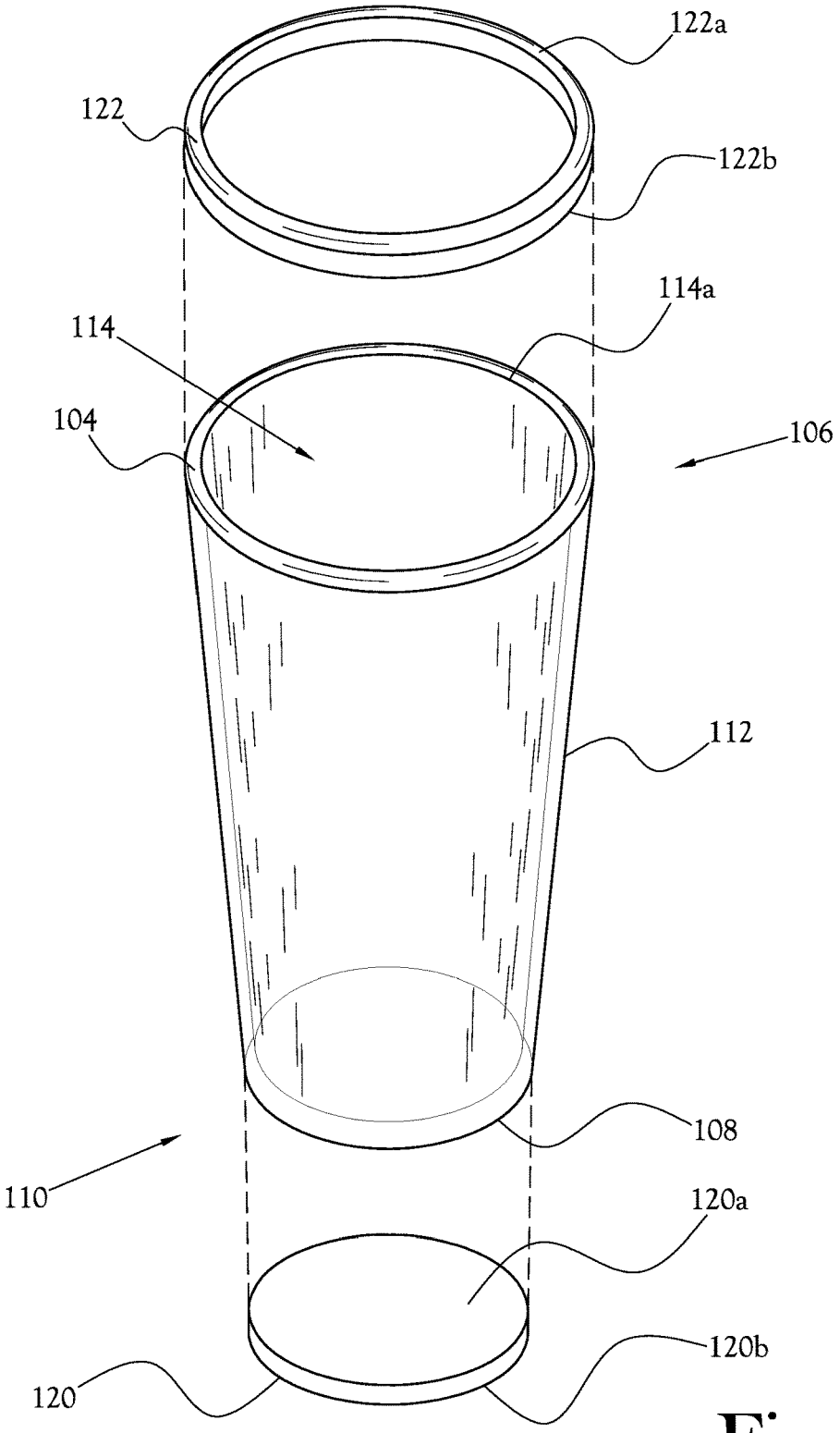
FIG. 2 is an exploded assembly view of the damage resistant glassware apparatus illustrated in FIG. 1.

FIG. 1 is a front prospective view of a damage resistant glassware apparatus 100 integrated with a first protective insert 120 and a second protective insert 122 according to an exemplary embodiment of the present general inventive concept. FIG. 2 is an exploded assembly view of the damage resistant glassware apparatus 100 illustrated in FIG. 1.

Referring to FIGS. 1 and 2, the damage resistant glassware apparatus 100 according to the present exemplary embodiment includes a fluid container 102 having a rim 104 at a top end 106, a base 108 at a bottom end 110, and sidewalls 112 extending from the base 108 to the rim 104. The fluid container 102 is constructed from a glass material and is configured to store a fluid or other substance within a cavity 114 defined by the rim 104, the sidewalls 112, and the base 108. The rim 104 defines an opening 114*a* to the cavity 114 of the fluid container 102, wherein a fluid may be stored.

In the present exemplary embodiment, the fluid stored within the cavity 114 is in direct contact with the fluid container 102 constructed from glass in order to insulate the fluid from an external environment. That is, the glass fluid container 102 insulates the fluid from the external environment to maintain a temperature of the fluid.

In the present exemplary embodiment, the damage resistant glassware apparatus 100 includes a first protective insert 120 integrally formed with the base 108 of the fluid container 102 and a second protective insert 122 integrally formed with the rim 104 of the fluid container 102. The first and second protective inserts 120, 122 are constructed from a non-glass material including a polymer, a rubber, a silicon, a metal, a wood, or any combinations thereof. The first protective insert 120 includes a top surface 120*a* and a bottom surface 120*b*. Similarly, the second protective insert includes a top surface 122*a* and a bottom surface 122*b*.

Figures 3A, 3B:
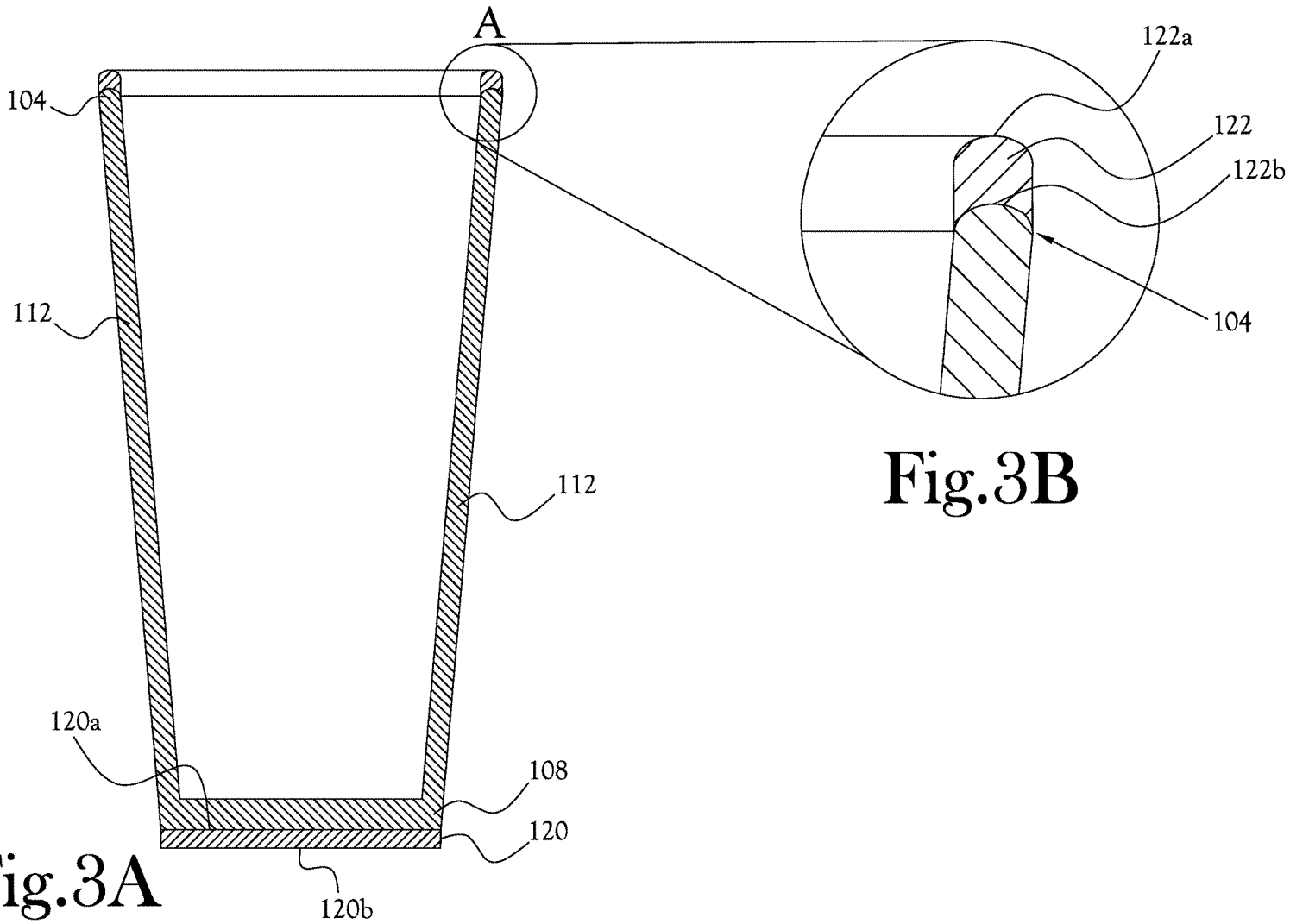
FIG. 3A is a cross-sectional view of the damage resistant glassware apparatus illustrated in FIG. 1.
FIG. 3B is an enlarged detail view of item 'A' illustrated in FIG. 3A.

FIG. 3A is a cross-sectional view of the damage resistant glassware apparatus 100 illustrated in FIG. 1 and FIG. 3B is an enlarged detail view of item 'A' illustrated in FIG. 3A.

Referring to FIGS. 3A and 3B, the bottom surface 122*b* of the second protective insert 122 is permanently affixed to the rim 104 of the fluid container 102 and the top surface 120*a* of the first protective insert 120 is permanently affixed to the base 108 of the fluid container 102. An inner and outer diameter of the second protective insert 120 is designed to correspond with an inner and outer diameter of the rim 104 of the fluid container. That is, the second protective insert 122 is designed to have a similar inner diameter of the rim 104 and a similar outer diameter of the rim 104 so as to appear uniform and/or seamless with the fluid container 102.

In the present exemplary embodiment, the first and second protective inserts 120, 122 are configured and/or designed to absorb an impact when dropped or stacked with other glassware to thereby protect and/or substantially reduce damage (i.e., chips or cracks) to the fluid container 102. The first and second protective inserts 120, 122 are constructed from a non-glass material so as to absorb a force applied to the rim 104 or the base 108 of the fluid container 102, when dropped. Conventional glassware containers are brittle and susceptible to cracks and chips when dropped or stacked for storage. The first and second protective inserts according to the present inventive concept absorbs a force applied to the glass fluid container 102 so as to prevent damage to the rim 104 and/or base 108 of the fluid container 102.

In exemplary embodiments, the top surface 122*a* of the first protective insert 120 is rounded so as to evenly distribute the force applied thereto when dropped over the entire surface of the second protective insert 122, thereby protecting the rim 104 and the sidewalls 112 from chips and/or cracks when dropped.

In alternative exemplary embodiments, the first and/or second protective insert 120, 122 may be constructed from an elastic material so as to absorb a force applied on the rim 104 and the base 108 of the fluid container 102 when bumped into an object or dropped.

In an exemplary embodiment, the first and second protective inserts 120 and 122 are permanently affixed to the bottom and top end of the fluid container 102, respectively, during a manufacturing process of the damage resistant glassware apparatus 100. However, the present general inventive concept is not limited thereto. That is, in alternative exemplary embodiments, the first and second protective inserts 120 and 122 may be affixed on glass fluid containers 102 by any known or conventional attachment method including using an adhesive, welding, or heating and attaching the protective inserts 120, 122 to the glass fluid container 102.

In the present exemplary embodiment, the first and second protective inserts 120, 122 are formed to be seamless with the fluid container 102, without having a visual or physical distinction from the fluid container 102. That is, the first and second protective inserts 120, 122 are designed, formed, and manufactured so as to be a continuation of the sidewall 112 of the fluid container 102, having no visible distinction or edge between the first and second protective inserts 120 and 122 and the fluid container 102. For instance, the first and second protective inserts 120, 122 are designed, formed, and manufactured so as to have the same width, diameter, texture, color and/or level of transparency as the fluid container 102.

In exemplary embodiments, the first and second protective inserts 120, 122 are constructed from a transparent or semi-transparent plastic material or elastic type material so as to provide a user with visibility to the fluid or substance stored within the fluid container 102, from all directions. That is, in the present exemplary embodiment, the fluid or substance stored within the fluid container 102 is visible from all sides and angles around and/or through the first and second protective inserts 120, 122, the rim 104, the base 108, and the sidewalls 112 of the fluid container 102. As such, the user may be visually stimulated by the liquid stored within the fluid container 102 while the damage resistant glassware apparatus 100 is placed on a table and also while the user is consuming the fluid through the opening 114*a* of the fluid container 102. In addition, the user is also able to clearly visualize an amount of liquid remaining within the fluid container 102 from all directions due to having a clear line of sight to the fluid through the first and second protective inserts 120, 122, the sidewalls 112, and the base 108 of the fluid container 102.

In further alternative exemplary embodiments, at least one of the first and second protective inserts 120, 122 includes a phosphorescent glow-in-the-dark material to receive light energy and to emit a glow of light visible in a dark or low light environment generated from the received light energy.

In alternative exemplary embodiments, the damage resistant glassware apparatus 100 may further include a friction member (not illustrated) coupled to the bottom surface 120*b* of the first protective insert 120 to increase friction between the base 108 and a surface the damage resistant glassware apparatus 100 is placed on (e.g., a table). The friction member may be formed of a rubber, a silicone, a polymer, or the like to prevent slippage of the glassware apparatus 100. However, the present general inventive concept is not limited thereto.

Figure 4B:
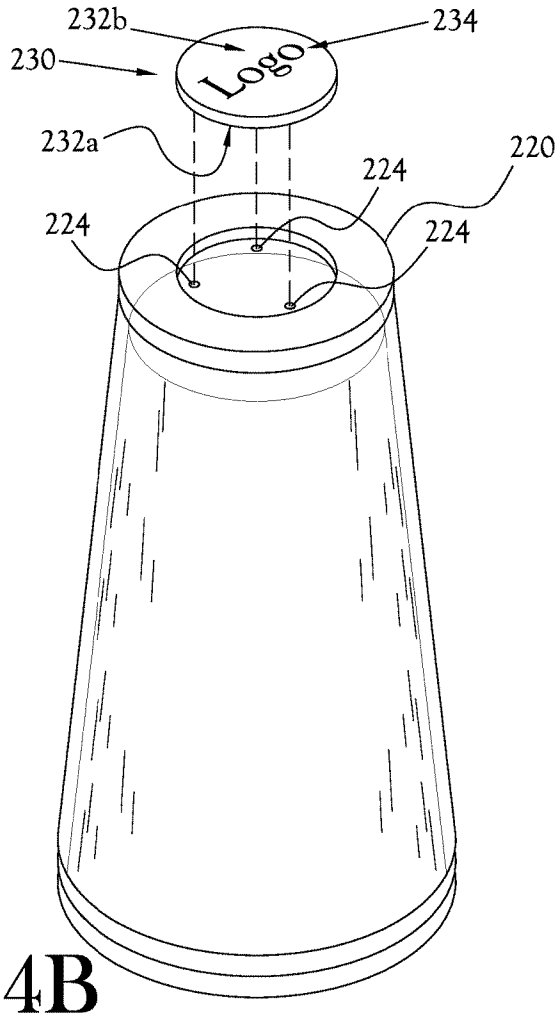
FIG. 4B is a bottom perspective exploded assembly view of the damage resistant glassware apparatus illustrated in FIG. 4A.
Figure 4A:
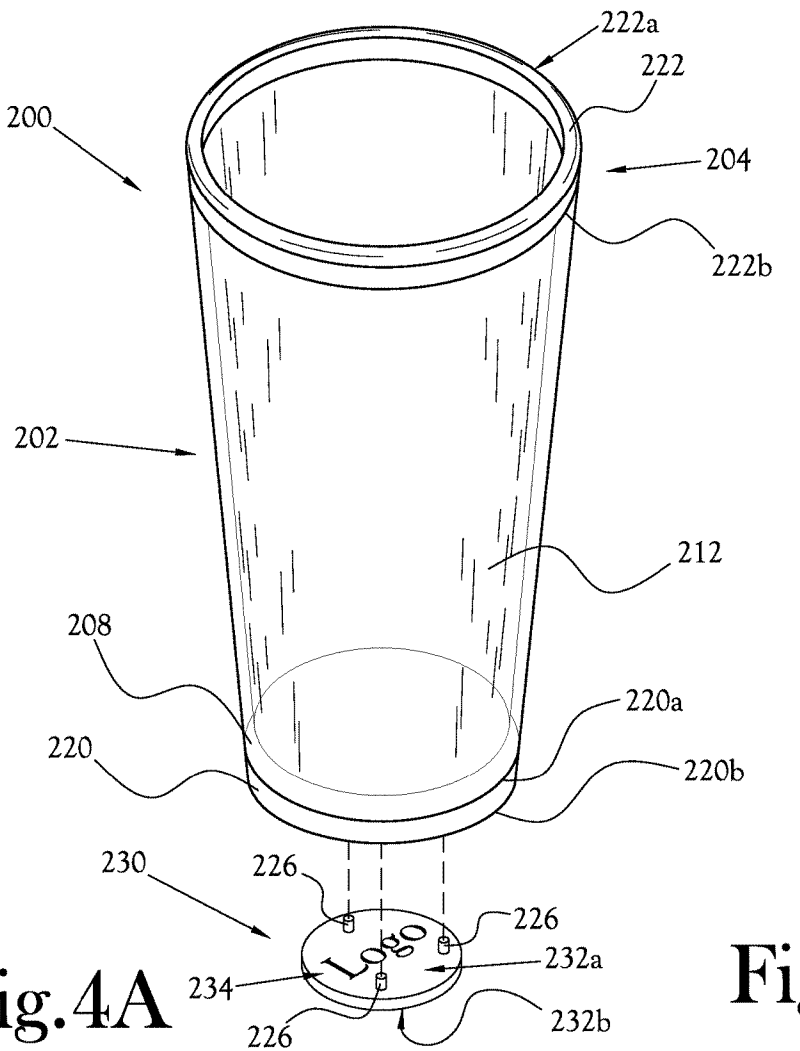
FIG. 4A is a front perspective exploded assembly view of a damage resistant glassware apparatus according to another exemplary embodiment of the present general inventive concept.

FIG. 4A is a front perspective exploded assembly view of a damage resistant glassware apparatus 200 according to another exemplary embodiment of the present general inventive concept. FIG. 4B is a bottom perspective exploded assembly view of the damage resistant glassware apparatus 200 illustrated in FIG. 4A.

Referring to FIGS. 4A and 4B, in exemplary embodiments, the damage resistant glassware apparatus 200 may include a first protective insert 220 integrally formed with the base 208 of the fluid container 202 and a second protective insert 222 integrally formed with a rim 204 of the fluid container 202. The first and second protective inserts 220, 222 are constructed from a non-glass material including a polymer, a rubber, a silicon, a metal, a wood, an elastic material, or any combinations thereof. The second protective insert 222 includes a top surface 222*a* and a bottom surface 222*b*.

In the present exemplary embodiment, the first protective insert 220 further includes a plurality of coupling members 224 (e.g., coupling holes) disposed on the bottom surface 220*b* of the first protective insert 220 which are configured to detachably attach or couple to a plurality of attachment members 226 (e.g., protrusions) extending from a detachable insert member 230.

In the present exemplary embodiment, the plurality of attachment members 226 extending from the insert member 230 correspond to and align with the plurality of coupling members 224 disposed on the first protective insert 220. In exemplary embodiments, a message and/or logo 234 may be disposed or written on a top surface 232*a* and/or bottom surface 232*b* of the insert member 230. The message or logo 234 may advertise a company or a sports team. However, the present general inventive concept is not limited thereto.

In the present exemplary embodiment, the message and/or logo 234 may be disposed on a top surface 232*a* of the insert member 230 so that a user may view the logo 234 through the first and second protective inserts 220, 222, the sidewall 212, and base 208 of the fluid container 202, while drinking a fluid stored therein. However, the present general inventive concept is not limited thereto. That is, in alternative exemplary embodiments the logo 234 may be disposed on the bottom surface 232*b* of the insert member 230.

Figure 5:
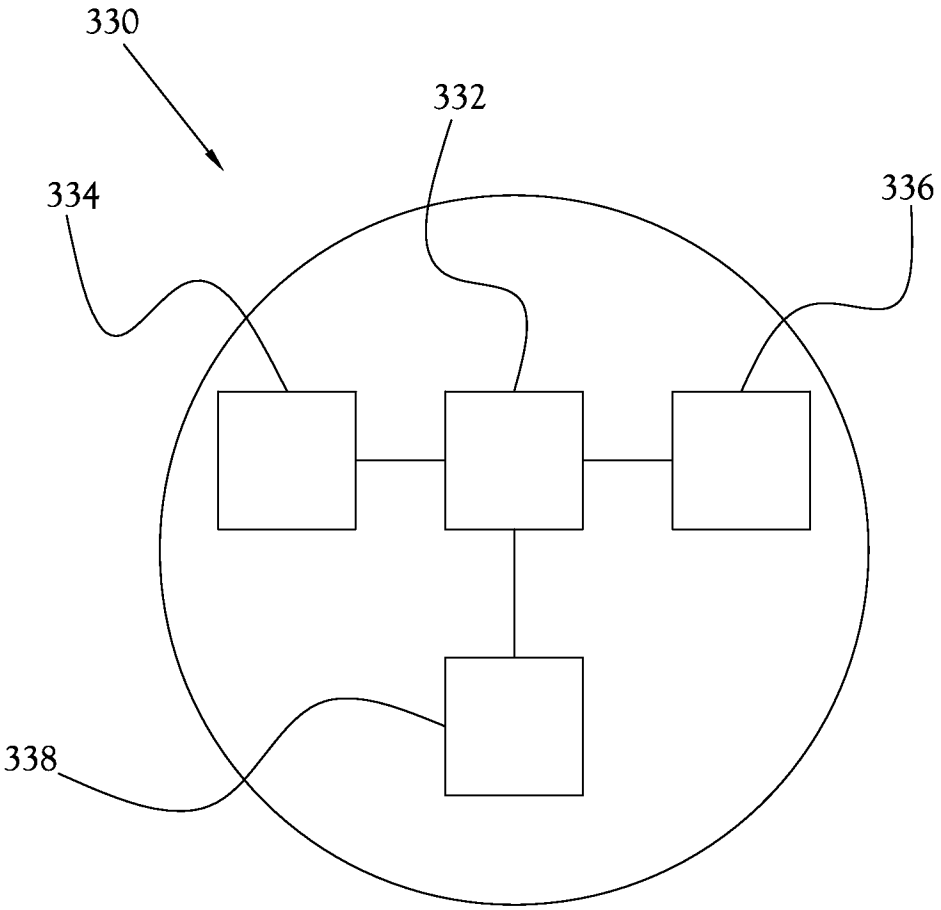
FIG. 5 is a schematic diagram of an insert member according to another exemplary embodiment of the present general inventive concept.

FIG. 5 is a schematic diagram of an insert member 330 according to another exemplary embodiment of the present general inventive concept.

Referring to FIG. 5, the insert member 330 according to the present exemplary embodiment includes a plurality of attachment members which correspond to a plurality of coupling members disposed on the first protective insert 222 as discussed above in the previous exemplary embodiment. That is, the insert member 330 may be detachably coupled to the first protective insert 220 integrally formed with the fluid container 202.

In the present exemplary embodiment, the insert member 330 further includes a controller 332 electrically coupled to a light source 334, a power source 336, and a pressure sensor 338 formed within the insert member 330. That is, the controller 332, light source 334, power source 336, and pressure sensor 338 may be housed within the insert member 330. The pressure sensor 338 may extend from the top surface 232*a* and is disposed adjacent to the bottom surface 220*b* of the first protective insert 220 such that a weight of a liquid stored within the fluid container 202 is transferred directly onto the pressure sensor 338.

Once the insert member 330 is removably affixed to the first protective insert 220, the controller 332 is configured to provide power from the power source 336 to the light source 334 when a signal is received from the pressure sensor 338.

In the present exemplary embodiment, the pressure sensor 338 is configured to detect an amount of pressure or force disposed thereon from the fluid stored within the fluid container 202. For instance, the pressure sensor 338 may detect an amount of liquid placed within the fluid container 102 based on an amount of pressure or force applied by the liquid. The pressure sensor 338 may be configured and calibrated to output a first signal when the liquid is below a predetermined target and a second signal when the liquid is above the predetermined target. However, the present general inventive concept is not limited thereto.

In an exemplary embodiment, the pressure sensor 338 is configured to output the first signal to the controller 332 when the liquid occupies less than half of an available volume of the fluid container 202, thereby indicating the glassware apparatus 200 is empty. Conversely, the pressure sensor 338 is configured to output the second signal to the controller 332 when the liquid occupies greater than half of an available volume of the fluid container 202, thereby indicating the glassware apparatus 200 is full. However, the present general inventive concept is not limited thereto. That is, in exemplary embodiments, a user may define the predetermined target to correspond to various levels of fluid stored within the fluid container 202.

In the present exemplary embodiment, the controller 332 is configured to control the light source 334 to emit a first color (e.g., red) when the pressure sensor 338 outputs the first signal to thereby indicate the fluid container 202 is empty. Likewise, the controller 332 is configured to control the light source 334 to emit a second color (e.g., green) when the pressure sensor outputs the second signal to indicate a full fluid container 202. However, the present general inventive concept is not limited thereto.

In operation, a bar tender may readily see the emitted light from across a bar and would be visually notified of an amount of fluid remaining in the user's glassware apparatus 200. A red light which indicates that the user's glassware apparatus is empty and a green light which indicates that the user's glassware apparatus is full.

In exemplary embodiments, the detachable insert member 330 is configured to detect a pressure corresponding to an amount of fluid stored within the fluid container 202. The controller 332 is configured to send a first signal to the light source 334 to emit a first color (e.g., red) when the amount of fluid stored within the container is below a predetermined level and to send a second signal to the light source to emit a second color (e.g., green) when the amount of fluid is above the predetermined level. In exemplary embodiments, the detachable insert member 330 may be adjusted to emit a plurality of different colors and/or patterns to correspond with the first and/or second signal, as desired.

Figure 6B:
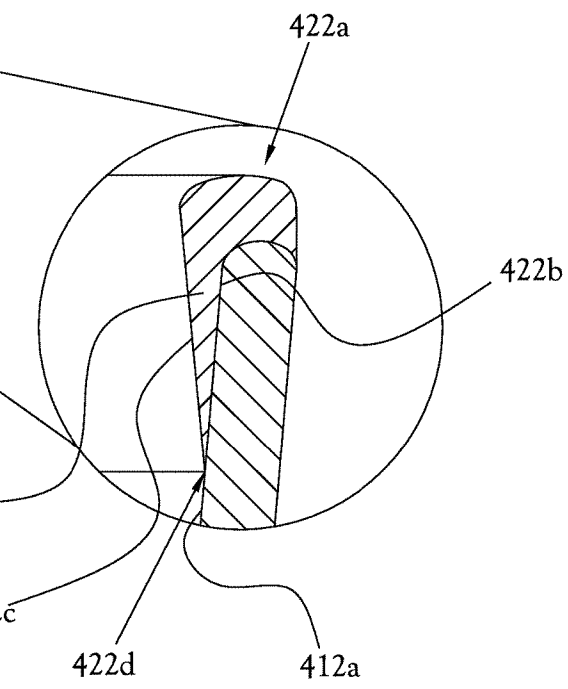
FIG. 6B is an enlarged detail view of item 'B' illustrated in FIG. 6A.
Figure 6A:
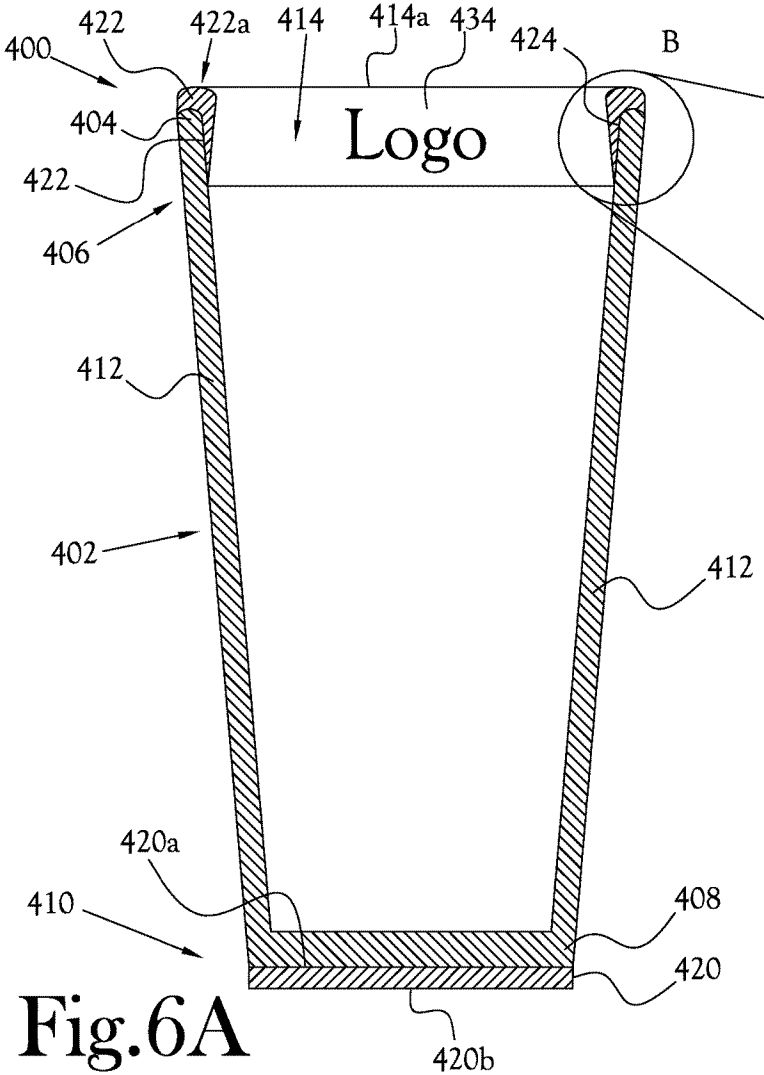
FIG. 6A is a cross-sectional view of a damage resistant glassware apparatus according to another exemplary embodiment of the present general inventive concept.

FIG. 6A is a cross-sectional view of a damage resistant glassware apparatus 400 according to another exemplary embodiment of the present general inventive concept and FIG. 6B is an enlarged detail view of item 'B' illustrated in FIG. 6A.

Referring to FIGS. 6A and 6B, the damage resistant glassware apparatus 400 according to the present exemplary embodiment includes a fluid container 402 having a rim 404 at a top end 406, a base 408 at a bottom end 410, and sidewalls 412 extending from the base 408 to the rim 404. The fluid container 402 is constructed from a glass material and is configured to store a fluid or other substance within a cavity 414 defined by the rim 404, the sidewalls 412, and the base 408. The rim 404 defines an opening 414*a* to the cavity 414 of the fluid container 402, wherein a fluid may be stored.

In the present exemplary embodiment, a top surface 420*a* of a first protective insert 420 is affixed to the base 408 of the fluid container 402 and a second protective insert 422 is affixed to the rim 404 of the fluid container 402. In an exemplary embodiment, the first protective insert 420 and the second protective insert 422 are constructed from a non-glass material and are permanently affixed to the fluid container 402, during a manufacturing process thereof.

In the present exemplary embodiment, the second protective insert 422 further includes a support member 424 which extends within the cavity 414 to provide support for attachment of the second protective insert 422 to the fluid container 402. The support member 424 extends from a top surface 422*a* of the first protective insert 422 to an interior surface 412*a* of the sidewall 412. The support member 424 is designed to provide a smooth and continuous path for the liquid stored within the cavity 414 to flow toward the opening 414*a*. That is, an intersection 422*d* between the interior surface 412*a* of the sidewall 412 and the support member 424 is formed so as no lip or protrusion is created to thereby allow fluid to easily flow over the support member 424 and out through the opening 414*a*.

Referring to FIGS. 6A and 6B, in an exemplary embodiment, the damage resistant glassware apparatus 400 may include a first protective insert 420 integrally formed with the base 408 of the fluid container 402 and a second protective insert 422 integrally formed with a rim 404 of the fluid container 402. The first and second protective inserts 420, 422 are constructed from a non-glass material including a polymer, a rubber, a silicon, a metal, a wood, an elastic material, or any combinations thereof. The second protective insert 422 includes a top surface 422*a*, a bottom surface 422*b*, and an inner surface 422*c*.

In the present exemplary embodiment, the first protective insert 420 further includes a plurality of coupling members (e.g., coupling holes, not illustrated) disposed on the bottom surface 420*b* of the first protective insert 420 which are configured to detachably attach to a plurality of attachment members (e.g., protrusions, not illustrated) extending from a detachable insert member.

In the present exemplary embodiment, the plurality of attachment members extending from the insert member corresponds to and aligns with the plurality of coupling members disposed on the first protective insert 420, similar to previous exemplary embodiments described herein. In exemplary embodiments, a message and/or logo 434 may be disposed or written on the inner surface 422*c* and/or the bottom surface 422*b* of the second protective insert 422. The message or logo 434 may advertise a company, business, or a sports team. However, the present general inventive concept is not limited thereto.

The present general inventive concept further includes a method of manufacturing a damage resistant glassware apparatus. In the present exemplary embodiment, the method includes obtaining a fluid container having a rim at a top end, a base at a bottom end, and sidewalls extending from the base to the rim. The fluid container is constructed from a glass material and is configured to store a fluid within a cavity defined by the sidewalls and the base. A surface of the fluid container may be cleaned and sanded to provide a surface to which the first and second protective inserts may bond to.

A first protective insert constructed from a non-glass material may then formed and shaped identical or similar to the rim of the fluid container. Similarly, a second protective insert also constructed from a non-glass material may then be shaped to have a diameter corresponding to the base of the fluid container.

Next, the first protective insert is permanently affixed to the rim of the fluid container and the second protective insert is permanently affixed to the base of the fluid container using an adhesive or various known bonding techniques.

In the present embodiment, the first protective insert is configured to allow access to a fluid stored within a storage cavity of the fluid container. The first and second protective inserts are permanently affixed, molded, and/or glued onto the fluid container to thereby provide complete visibility to the fluid stored within the storage cavity from all directions around and through the rim, the base, and the sidewalls of the fluid container. The first protective insert and the second protective insert are formed and affixed so as to be seamless and/or integrally formed with the rim, the base and the sidewalls of the fluid container.

In exemplary embodiments of the method of manufacturing a damage resistant glassware apparatus further includes coupling a friction member (not illustrated) to a surface of the first protective insert to prevent slippage of the base of the fluid container.

In alternative exemplary embodiments, the method further includes forming at least one of the first and second protective inserts to include a phosphorescent glow-in-the-dark material to receive light energy and to emit a glow of light visible in a dark environment generated from the received light energy.

The present general inventive concept provides a damage resistant glassware apparatus which protects edges and bottoms of glassware containers from damage when dropped while providing a user with complete visibility to the contents stored within the container. The damage resistant glassware apparatus includes a fluid container constructed of glass having a top end and a bottom end, a first protective non-glass insert integrally formed with the top end of the fluid container and a second protective non-glass insert integrally formed with the bottom end of the fluid container. The first and second protective inserts are configured to absorb a force applied to the top and bottom of the fluid container when the damage resistant glassware apparatus is dropped or stacked for storage.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

What is claimed is:

1. A damage resistant glassware apparatus, comprising:

a fluid container having a rim at a top end and a base at a bottom end, the fluid container constructed of a glass material, the rim to define an opening to a storage cavity within the fluid container to store a fluid;

a first protective insert coupled to and integrally formed with the base; and a second protective insert coupled to and integrally formed with the rim, wherein an inner diameter of the second protective insert corresponds with an inner diameter of the fluid container and is configured to be uniform with the fluid container, and wherein the first and second protective inserts are constructed of a non-glass material to protect the fluid container.

2. The damage resistant glassware apparatus of claim 1, wherein the first and second protective inserts are configured to absorb a force of impact when dropped to protect the fluid container.

3. The damage resistant glassware apparatus of claim 2, wherein the first and second protective inserts are constructed from a transparent plastic material to provide complete visibility to the fluid stored within the storage cavity from all directions.

4. The damage resistant glassware apparatus of claim 3, wherein the first and second protective inserts are permanently affixed to the fluid container during a manufacturing process.

5. The damage resistant glassware apparatus of claim 2, wherein the first and second protective inserts are constructed from an elastic material configured to absorb the force of impact when dropped and to shield the fluid container from the force.

6. The damage resistant glassware apparatus of claim 2, wherein the first protective insert is coupled to a friction member to prevent slippage.

7. The damage resistant glassware apparatus of claim 2, wherein at least one of the first and second protective inserts includes a phosphorescent glow-in-the-dark material to receive light energy and to emit a glow of light visible in a dark environment generated from the received light energy.

8. A damage resistant glassware apparatus, comprising:

a fluid container having a rim at a top end and a base at a bottom end, the fluid container constructed of a glass material, the rim to define an opening to a storage cavity within the fluid container to store a fluid; and a first protective insert coupled to and integrally formed with the base; and a second protective insert coupled to and integrally formed with the rim, wherein an outer diameter of the first protective insert corresponds with an outer diameter of the fluid container and is configured to be uniform with the fluid container, and wherein an inner and outer diameter of the second protective insert respectively correspond with an inner and the outer diameter of the fluid container and are configured to be uniform with the fluid container, wherein the first and second protective inserts are constructed of a non-glass material to protect the fluid container.

9. The damage resistant glassware apparatus of claim 8, wherein the first protective insert includes an attachment member to detachably couple to a detachable insert member.

10. The damage resistant glassware apparatus of claim 9, wherein the detachable insert member comprises a light source, a pressure sensor, a power source, and a controller to control a light emitted from the light source based on a signal received from the pressure sensor.

* * * * *